US006044502A

United States Patent [19]

Fountain

[11] Patent Number: 6,044,502

[45] Date of Patent: Apr. 4, 2000

[54] SINK STRAINER CLAMP

[76] Inventor: Thomas R. Fountain, P.O. Box 991, Warner Robins, Ga. 31099

[21] Appl. No.: 09/067,235

[22] Filed: Apr. 27, 1998

[51] Int. Cl.[7] ..... A47K 1/00

[52] U.S. Cl. ..... 4/661; 81/176.15

[58] Field of Search ..... 4/661; 81/176.15, 81/462, DIG. 1; 211/105.6

[56] References Cited

U.S. PATENT DOCUMENTS

| | | | |
|---|---|---|---|
| 1,140,570 | 5/1915 | Buckley | 211/105.6 |
| 2,659,256 | 11/1953 | Palmer | 81/176.15 |
| 3,213,720 | 10/1965 | Wallis et al. | 81/90 |
| 3,832,917 | 9/1974 | Feith | 81/462 |
| 4,059,033 | 11/1977 | Johnson | 81/3.1 |
| 4,835,798 | 6/1989 | Hernandez | 4/661 X |

*Primary Examiner*—Robert M. Fetsuga
*Attorney, Agent, or Firm*—Thomas, Kayden, Horstemeyer & Risley

[57] ABSTRACT

A sink strainer clamp comprises a body, a pair of opposing arm segments telescopingly engaging said body with each of said arm segments having an arm extension with a first end for engaging the interior surface of a basin, and interchangeable adapter fittings removably attached to said body with each adapter fitting adapted for engaging a different strainer configuration. The body incorporates an internal spring for outwardly biasing the arm segments so that the arm segments can be compressed against the spring to facilitate placement of the clamp within a basin. After placing the clamp within a basin, the adapter is aligned to engage the strainer of the basin and the arm segments are then released to securely retain the clamp within the basin. A retaining nut which mounts the strainer to the basin can then be removed by the person who installed the clamp.

5 Claims, 4 Drawing Sheets

SINK STRAINER CLAMP

FIELD OF THE INVENTION

The present invention relates generally to plumbing tools. More specifically, the present invention relates to a sink strainer clamp that retains the position of a sink strainer while the retaining nut, which is located beneath the sink and holds the strainer to the sink, is loosened and is removed from the sink strainer, thereby allowing one person to remove the sink strainer.

DESCRIPTION OF THE PRIOR ART

Sinks and bath tubs typically include, a basin, water supply and control fixtures attached to the upper portion of the basin, and an opening or drain formed at the lower portion of the basin. The drain provides a path for the contents of the basin to exit the basin, and also provides a mounting surface for plumbing drain pipes which typically connect the basin to waste water disposal or sewer lines. The drain also can incorporate a strainer which typically mounts across the drain opening and provides a physical barrier for preventing items, such as kitchen utensils, cleaning sponges, etc., from entering the drain pipes and clogging the basin drain. The strainer is typically attached to the basin by a strainer retaining nut which clamps the strainer to the perimeter edge of the drain opening.

Occasionally, a strainer must be removed from a basin for maintenance, such as to enlarge the drain opening in order to accommodate the insertion of a plumber's snake device for cleaning or unclogging the plumbing pipes, or for mounting a garbage disposal to the sink, etc. However, removal of a strainer from a basin typically requires the use of two people, with the first person leaning over and into the basin to secure the position of the strainer with a tool, such as with a common wrench or pair of pliers, so that the strainer is not free to rotate, while the second person reaches below the basin and loosens and removes the threaded strainer retaining nut. This two-person process is required because the size and shape of the basin often prevents one person from being able to simultaneously secure the position of the strainer mounted within the basin with one hand, while reaching below the basin to loosen the strainer retaining nut with the other hand. Therefore, it is desirable to provide a device that would allow one person to remove, as well as install, basin strainers.

Further, it would be desirable to provide a device that is adaptable to a variety of basin and strainer configurations, thereby providing a convenient means for one person to attach and remove strainers of various sizes and shapes.

SUMMARY OF THE INVENTION

Briefly described, the present invention comprises a device for attaching to and retaining the position of a basin strainer relative to the basin to which it is mounted, while a person either installs or removes a strainer retaining nut which fastens the strainer to the basin. The device includes a central body portion which encases a spring assembly, and opposing arm segments which adjustably and telescopingly engage the body and which are each biased by the spring assembly to extend outwardly from the body. This telescopingly-biased configuration allows the device to adjustably mount within basins of various sizes and shapes by allowing the opposing arm segments to partially retract within the body by compressing the spring so that the device can be placed within a basin, and thereafter, allowing the spring to extend the arm segments outwardly from the body so that the arm segments can engage opposed interior surfaces of the basin for mounting. Additionally, each arm segment also can incorporate an arm extension which engages the segment and which can be adjusted to extend or retract from the segment to adjust the fit of the device within a basin. Each arm segment, or arm extension on embodiments so configured, also can incorporate an end or tip portion made of a material suited to enhance the friction mounting of the device within the basin while preventing abrasion of the interior basin surface.

Interchangeable adapter fittings are also provided which are removably mounted to the body with each adapter fitting configured to engage a specific strainer configuration so that the sink strainer clamp can be adapted to engage strainers of various sizes and shapes. In some embodiments, the adapter fittings are mounted to an adapter extension which is fixed to the body of the device, while in other embodiments the adapter fittings are mounted to a movable adapter extension which can be mounted at various positions along the length of the body so that the adapter fitting can be placed directly over a sink strainer which is not centered in the sink basin.

Operation of the sink strainer clamp is accomplished by selecting an adapter fitting which is configured to engage the strainer that is to be removed, and attaching the adapter fitting to the adapter extension of the clamp. The opposing arm segments of the clamp are then compressed against the biasing spring until the clamp can be placed within the basin interior. The clamp is then lowered into the basin until the adapter fitting securely engages the strainer, and then the arm segments are allowed to extend outwardly from the body until the tip portion of each arm segment engages an interior side wall or interior corner of the basin, with the final tension adjustment of the arm segments made by adjusting the arm extensions. In this configuration, the friction formed between the tip portions and the basin substantially secures the clamp within the basin, and likewise, substantially secures the position of the strainer relative to the basin so that the person employing the clamp can lean below the basin and remove the strainer retaining nut without requiring the help of an additional person. Once the retaining nut is removed, the arm segments are compressed against the encased spring so that the adapter fitting can be disengaged from the strainer, thereby allowing the clamp to be removed from the basin. With the retaining nut removed, the strainer also can be removed from the drain opening and from the basin.

One person also can attach a strainer to a basin while employing the sink strainer clamp by reversing the above stated procedure.

Therefore, it is an object of the present invention to provide a sink strainer clamp that allows one person to remove, as well as install, basin strainers without requiring the help of an additional person.

It is another object of the present invention to provide a sink strainer clamp that is adaptable to a variety of strainer configurations, thereby providing a convenient means for attaching and removing strainers of various sizes and shapes.

It is yet another object of the present invention to provide a sink strainer clamp that is adaptable to a variety of basin configurations, so that the sink strainer clamp provides a convenient means for attaching and removing strainers of basins of various sizes and shapes.

It is a further object of the present invention to provide a sink strainer clamp that is configured to engages the interior of a basin in a manner that does not scratch or abrade the interior surface of the basin.

Other objects, features and advantages of the present invention will become apparent upon reading the following specification, when taken in conjunction with the accompanying drawings.

BRIEF DESCRIPTION OF THE DRAWINGS

The accompanying drawings incorporated in and forming a part of the specification illustrate several aspects of the present inventions, and together with the description serve to explain the principles of the inventions. The components in the drawings are not necessarily to scale, emphasis instead being placed upon clearly illustrating principles of the present inventions.

DETAILED DESCRIPTION OF THE PREFERRED EMBODIMENTS

Figure 1:
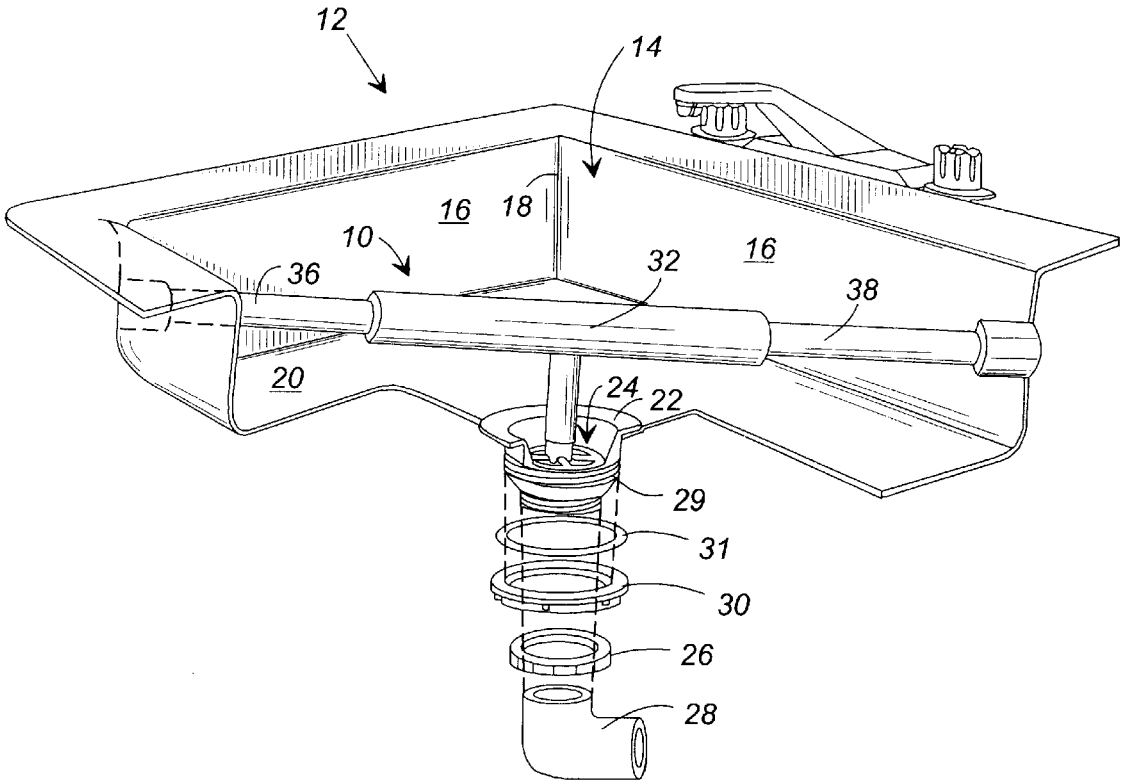
FIG. 1 illustrates a partially cut-away, partially exploded perspective view of an embodiment of the present invention engaging a sink strainer which is mounted within a basin; the basin has been partially cut-away and partially exploded for clarity.

Reference will now be made in detail to the description of the invention as illustrated in the drawings with like numerals indicating like parts throughout the several views. Referring to FIG. 1, the sink strainer clamp 10 of the present invention is shown mounted within a typical sink or basin 12 which incorporates an interior 14 defamed by side walls 16, interior corners 18 disposed between side walls 16, bottom 20, and strainer 22. Bottom 20 includes a drain opening 24 which cooperates with strainer 22 to form the drain of the basin 12. The strainer 22 also can incorporate attachment nut 26 which attaches the strainer 22 to plumbing pipe 28. An internally threaded strainer connecting or retaining nut 30 threadedly engages an externally threaded portion 29 of strainer 22 so that the strainer 22, a mounting gasket 31 interposed between strainer 22 and nut 30, and nut 30 are securely mounted to the basin 12 about opening 24.

Figure 2:
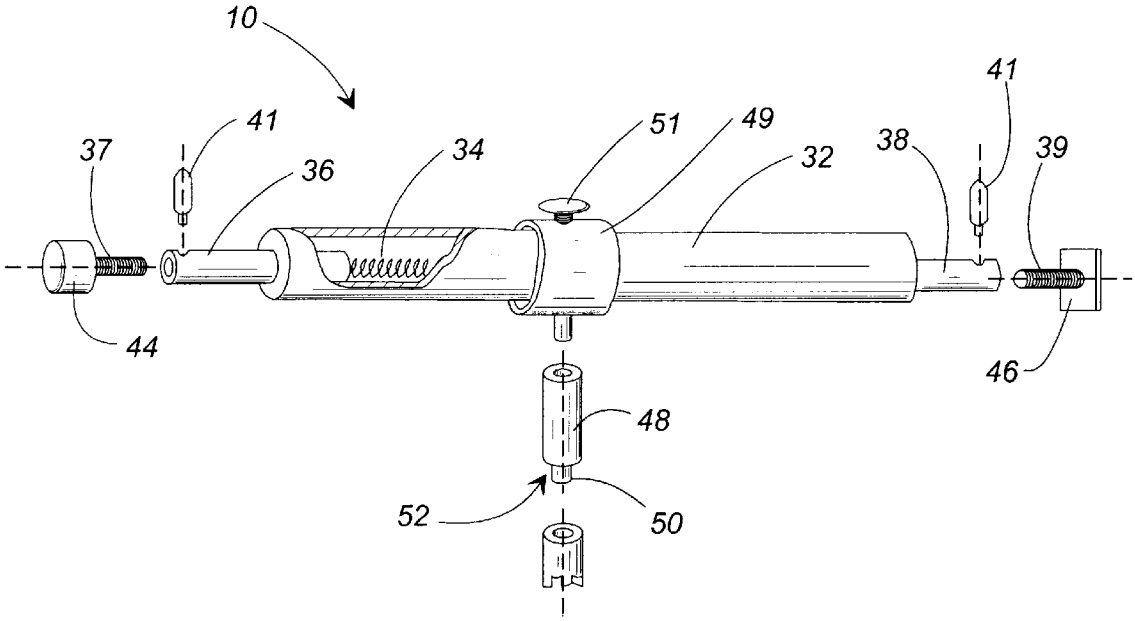
FIG. 2 illustrates a partially cut-away, partially exploded perspective view of the preferred embodiment of the present invention with arm segments extended and incorporating a movable adapter extension.
Figure 4:
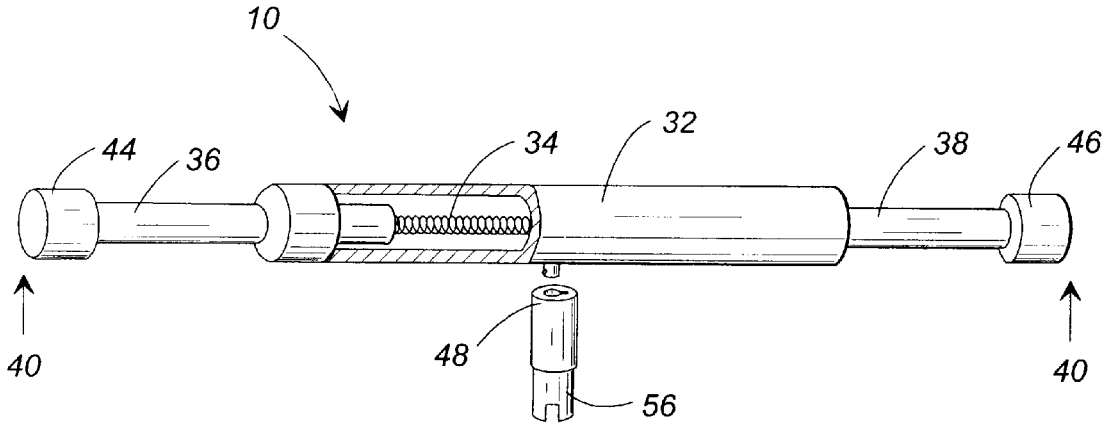
FIG. 4 illustrates a partially cut-away, perspective view of an embodiment of the present invention with the arm segments extended.
Figure 5:
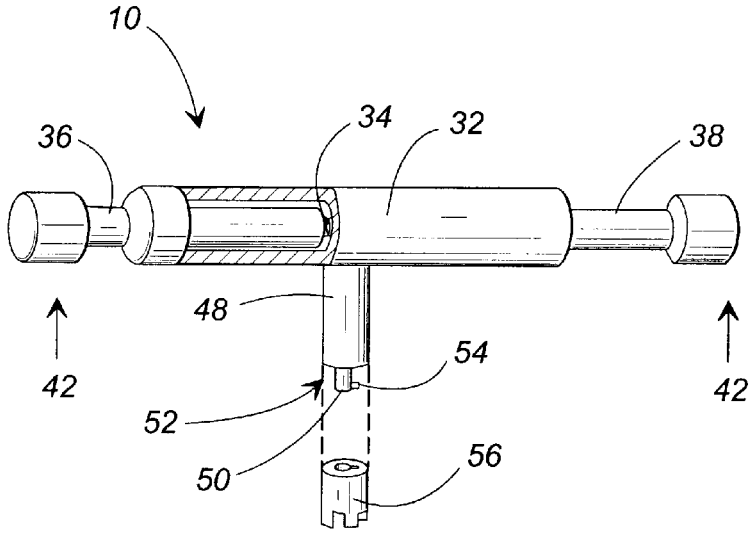
FIG. 5 illustrates a partially cut-away perspective view of an embodiment of the present invention with the arm segments retracted.

As shown in FIG. 2, the preferred embodiment of the strainer clamp 10 includes a central body portion 32 which encases a spring assembly 34 and opposing arm segments 36 and 38 which adjustably and telescopingly engage the body 32. Arm segments 36 and 38 are each biased to an extended position 40 (FIG. 4) by the spring assembly 34, and can be compressed to a retracted position 42 (FIG. 5). This telescopingly-biased configuration of the opposing arm segments 36 and 38 allows the clamp 10 to adjust to mount within basins of various sizes and shapes while providing for a secure friction mount within the basin. Arm segments 36 and 38 each can incorporate an arm extension, 37 and 39 respectively, which threadedly engage the arm segments so that the position of the arm extensions can be adjusted. Each arm segment also can incorporate a handle 41 which extends radially from the arm segment, thereby providing a convenient surface for a person to grasp when inserting the clamp 10 into a basin or when adjusting the arm extensions.

In embodiments incorporating arm extensions (i.e. FIG. 2), tip portions 44 and 46, made of a material such as rubber and configured in various shapes and sizes, can also be incorporated at the opposing ends of the arm extensions 37 and 39 in order to enhance the friction mounting of the strainer clamp 10 within a basin 12 while preventing scratching of the interior side walls of the basin 12. In those embodiments not incorporating arm extensions (i.e. FIGS. 4 and 5), the tip portions 44 and 46 can be mounted on opposing ends of the arm segments 36 and 38.

As shown in FIGS. 1, 2, 4 and 5, an adapter extension 48 is mounted to the body 32 and is adapted to independently and removably engage a series of adapter fittings 56 which are each configured to operatively engage a strainer 22. In the preferred embodiment (FIG. 2), the adapter extension 48 incorporates a sleeve 49 configured to slidably mount about the body 32. A retaining mechanism 51, such as a bolt, is also included to secure the position of the sleeve 49 relative the body 32 so that the adapter extension can be aligned with the strainer 22 of a basin 12 and then locked into position by the retaining mechanism 51. In other embodiments (FIG. 5), the adapter extension 48 is fixedly mounted to the body 32.

Figure 3:
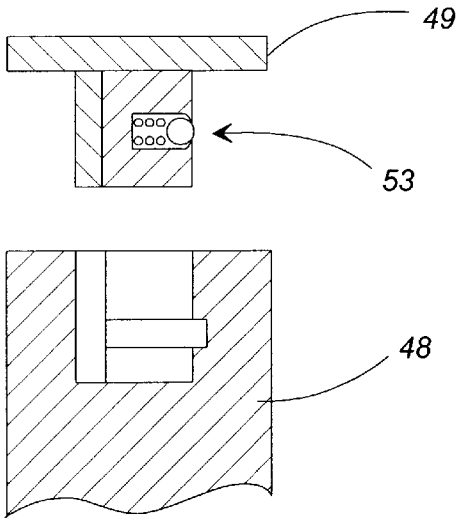
FIG. 3 illustrates a partially exploded cut-away view of the embodiment of FIG. 2 showing detail the removable adapter extension.

Additionally, some embodiments incorporate adapter extensions 48 which removably mount to the body 32, or removably mount to the sleeve 49 on embodiments incorporating a sleeve 49. As shown in FIG. 3, extension arm 48 can be removably mounted to body 32 or sleeve 49 by means of an attachment mechanism 53, shown as a captured ball bearing with a biasing spring such that the ball bearing engages a locking groove formed in the interior of adapter extension 48, however, the attachment mechanism 53 can be formed in numerous other conventional manners without departing from the scope of the invention.

Figure 6A:
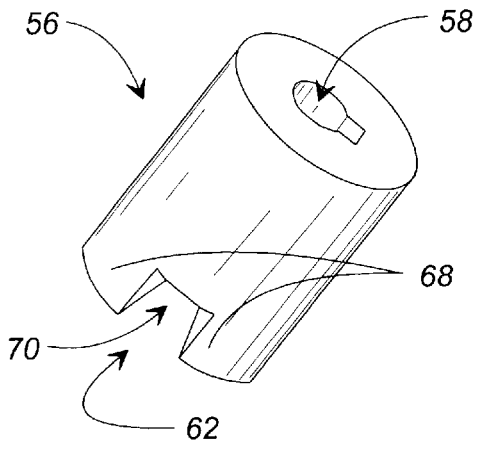
FIG. 6*a* illustrates a perspective view of an embodiment of an adapter fitting.
Figure 7A:
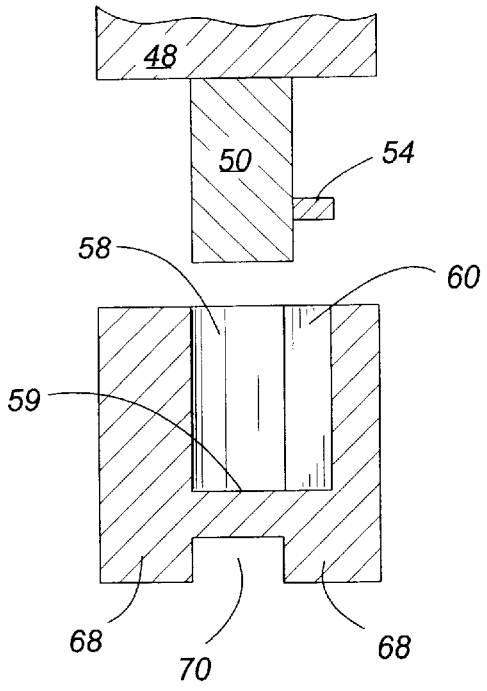
FIG. 7*a* illustrates a partially cut-away, partially cross-sectional view showing detail of an embodiment of the adapter fitting and locking member.

Each adapter extension 48 also includes a conventional mounting mechanism on an end portion 50 for non-rotatably mounting an adapter fitting 56 to the adapter extension 48. In some embodiments, end portion 50 incorporates a locking member 54 which protrudes radially from end portion 50. As shown in FIGS. 6*a* and 7*a*, adapter fitting 56 can incorporate a longitudinal bore 58 for engaging end portion 50, a bottom wall 59, a longitudinal groove 60 cooperating with longitudinal bore 58 for receiving locking member 54, and a tip or operative end 62 for engaging a strainer 22. Each adapter fitting 56 is mounted to the adapter extension 48 by inserting end portion 50 into the longitudinal bore 58 with the locking member 54 engaging the longitudinal groove 60, and then sliding the end portion 50 into bore 58 until end portion 50 engages bottom wall 59. In this manner, the locking member 54 is retained by the longitudinal groove 60, thereby substantially preventing the adapter fitting 56 from rotating relative to the adapter extension 48. The adapter 56 can be conveniently removed from the adapter extension 48 by removing end portion 50 from bore 58.

Figure 6B:
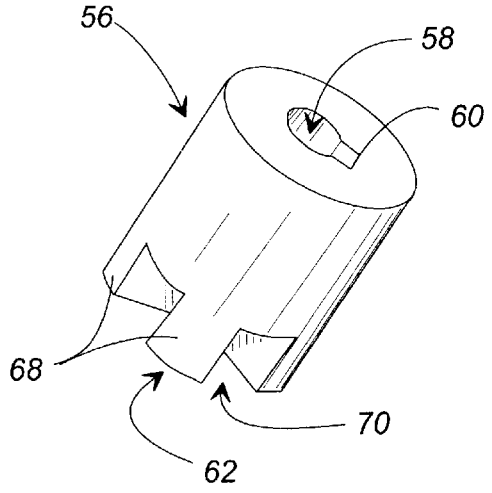
FIG. 6*b* illustrates a perspective view of an alternative embodiment of an adapter fitting.
Figure 7B:
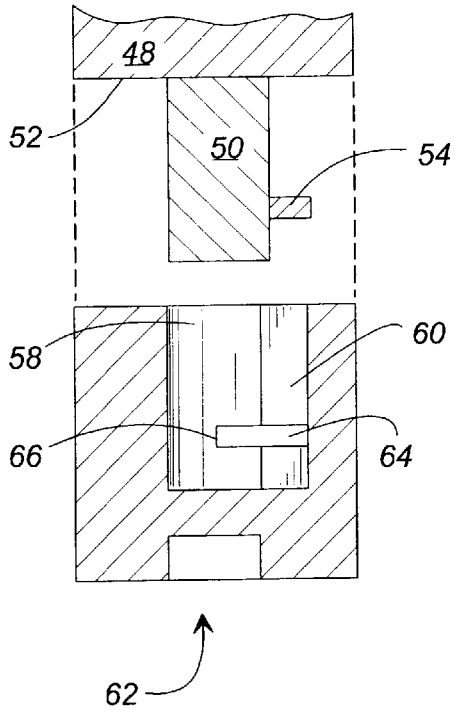
FIG. 7*b* illustrates a partially cut-away, partially cross-sectional view showing detail of an alternative embodiment of the adapter fitting and locking member.

As shown in FIGS. 6*b* and 7*b*, an alternative embodiment of the adapter fitting 56 can incorporate an interior locking groove 64 having an end wall 66. Locking groove 64 is radially disposed about a portion of the adapter fitting 56 and cooperates with both bore 58 and longitudinal groove 60 for receiving locking member 54. Each adapter fitting 56 is releasably mounted to the adapter extension 48 by inserting end portion 50 into the longitudinal bore 58 with the locking member 54 engaging the longitudinal groove 60, and then sliding the end portion 50 into bore 58 until locking member 54 engages locking groove 64. The adapter fitting 56 is then rotated so that locking member 54 resides within locking groove 64 and no longer engages longitudinal groove 60. In this manner, the locking member 54 is retained by the locking groove 64, thereby fastening the adapter fitting 56 to the adapter extension 48. Additionally, the locking member 54 is prevented from rotating past end wall 66 as locking member 54 engages end wall 66, thereby substantially preventing the adapter fitting 56 from rotating relative to the adapter extension 48. The adapter 56 can be conveniently removed from the adapter extension 48 by reversing the above stated procedure.

The operative end 62 of each adapter fitting 56 is adapted to engage a specific strainer configuration by incorporating an alternating series of raised segments 68 and recesses 70 of various arrangements which engage the strainers 22. Thus configured, the clamp 10 can be conveniently adapted to engage numerous strainer 22 configurations by interchanging the adapter fittings 56.

The method of using the sink strainer clamp 10 includes selecting an adapter fitting 56 which is configured to engage the strainer 22 that is to be removed. The adapter extension 48 is attached to the body 32 and the selected adapter fitting 56 is then attached to the adapter extension 48 of the clamp 10 as described above. The opposing arm segments 36 and 38 are then compressed against the biasing spring assembly 34 until the clamp 10 can be placed within the basin interior 14 in a substantially parallel orientation to the plane of the strainer 22. The clamp 10 is then lowered into the basin 12 until the operative end 62 of the adapter fitting 56 securely engages the strainer 22. The arm segments 36 and 38 are then allowed to extend toward their extended positions 40, until each of the tip portions 44 and 46 engage an interior side wall 16 or interior corner 18 of the basin 12 while the arm segments reside in a substantially parallel orientation to the plane of the strainer 22. The arm extensions 37 and 39 can then be adjusted to fine-tune the fit of the clamp 10 within the basin 12. In this configuration, the friction established between the tip portions 44 and 46 and the basin 12 will substantially secure the clamp 10 within the basin 12, and thereby substantially secure the position of the strainer 22 relative to the basin 12 so that a person employing the clamp 10 can lean below the basin 12 and remove the strainer retaining nut 30. Once the retaining nut 30 is removed, the arm segments 36 and 38 are compressed so that the operative end 62 can be disengaged from the strainer 22 and the clamp 10 can be removed from the basin 12. The strainer 22 can then be removed from the drain opening 24.

Attachment of strainer 22 is accomplished by reversing the above stated procedure.

The foregoing description has been presented for purposes of illustration and description. It is not intended to be exhaustive or to limit the invention to the precise forms disclosed. Obvious modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

COMPONENT LIST

| | | | |
|---|---|---|---|
| 10 | CLAMP | 50 | END PORTION |
| 12 | BASIN | 1 | RETAINING MECHANISM |
| 14 | INTERIOR | 2 | |
| 16 | SIDE WALLS | 3 | ATTACHMENT MECHANISM |
| 18 | CORNERS | 4 | LOCKING MEMBER |
| 20 | BOTTOM | 5 | |
| 22 | STRAINER | 6 | ADAPTER FITTING |
| 24 | DRAIN OPENING | 7 | |
| 26 | ATTACHMENT NUT | 8 | LONG. BORE |
| 28 | PLUMBING PIPE | 9 | BOTTOM WALL |
| 29 | THREADED PORTION | 60 | LONG. GROOVE |
| 30 | RETAINING NUT | 1 | |
| 31 | GASKET | 2 | OPERATIVE END |
| 32 | BODY | 3 | |
| 34 | SPRING ASSMEBLY | 4 | LOCKING GROOVE |
| 36 | ARM SEGMENT | 5 | |
| 37 | ARM EXTENSION | 6 | END WALL |
| 38 | ARM SEGMENT | 7 | |
| 39 | ARM EXTENSION | 8 | RAISED SEGMENTS |
| 40 | EXTENDED POSITION | 9 | |
| 1 | HANDLE | 70 | RECESSES |

Therefore, what is claimed is:

1. A sink strainer clamp for mounting within a basin and engaging a basin strainer, said sink strainer comprising:

an elongated body having a first end, a second end, and a longitudinal bore extending between said first and second ends;

first and second opposing arm segments, each of said arm segments having a first end configured to operatively engage the interior of a basin, and a second end configured to telescopically engage within said body;

a spring mounted within said longitudinal bore, said spring engaging said second end of each of said arm segments, said spring for biasing said arm segments outwardly from said body and away from each other; and an adapter fitting non-rotatably engaging said body and adapted and arranged to engage a strainer such that said adapter fitting substantially retains the position of the strainer relative to the basin while said arm segments engage the interior of the basin.

2. The clamp of claim 1, wherein said body has a first end and a second end, and is configured to receive a sleeve thereabout, said sleeve engaging said adapter fitting and being movable between said first and second ends of said body and being adjustably and securely positionable at positions therebetween such that said adapter fitting is adjustably and securely positionable for engagement with the strainer.

3. A sink strainer clamp for mounting in a basin having sidewalls and corners disposed between the sidewalls, and for engaging a strainer which is mounted in the drain of the basin with a retaining nut, and for retarding rotation of the strainer in response to rotating the retaining nut of the strainer, said sink strainer clamp comprising:

a body sized and shaped for placement over the drain of a basin;

an adapter non-rotatably mounted to said body, said adapter being sized and shaped for reaching from said body into the basin and to the strainer mounted in the drain of the basin, said adapter including a tip shaped for non-rotatably engaging the strainer;

opposing arm members engaging said body and each extending laterally from said body a distance sufficient to reach a corner between adjacent sidewalls of a basin; and biasing means for urging said arm members toward engagement with opposing corners of a basin to prevent rotation of said arm members, said body, and said adapter in response to rotating the retaining nut of the strainer, wherein said body has a first end and a second end, and is configured to receive a sleeve thereabout, said sleeve engaging said adapter and being movable between said first and second ends of said body and being adjustably and securely positionable at positions therebetween such that said adapter is adjustably and securely positionable for engagement with the strainer.

4. The clamp of claim 3, wherein said sleeve has an internally threaded radial bore extending therethrough and an externally threaded bolt configured to engage within said radial bore such that adjustment of said bolt within said radial bore provides adjustable and secure positioning of said sleeve between said first and second ends of said body.

5. A sink strainer clamp for mounting within a basin and engaging a basin strainer, said sink strainer comprising:

an elongated body;

first and second opposing arm segments, each of said arm segments having a first end configured to operatively engage the interior of a basin, and a second end configured to telescopically engage within said body;

biasing means mounted within said body for biasing said arm segments outwardly from said body and away from each other;

an adapter fitting non-rotatably engaging said body and adapted and arranged to engage a strainer such that said adapter fitting substantially retains the position of the strainer relative to the basin while said arm segments engage the interior of the basin; and an elongated adapter extension mounted to and extending outwardly from said body and adapted and arranged to receive one of said adapter fittings wherein said adapter extension is movably mounted to said body.

* * * * *